US005142883A

United States Patent [19]

DeWitt

[11] Patent Number: 5,142,883

[45] Date of Patent: Sep. 1, 1992

[54] PARTIALLY REDUNDANT AIR CONDITIONING SYSTEM

[76] Inventor: Jimmie W. DeWitt, 3144 Hardwood Dr., Port Neches, Tex. 77651

[21] Appl. No.: 674,110

[22] Filed: Mar. 25, 1991

[51] Int. Cl.[5] ..... F25B 29/00

[52] U.S. Cl. ..... 62/298; 62/510; 62/265

[58] Field of Search ..... 62/440, 259.1, 298, 62/415, 335, 265, 510; 98/39.6, 31.6

[56] References Cited

U.S. PATENT DOCUMENTS

| | | | |
|---|---|---|---|
| 2,091,563 | 8/1937 | Palmer | 62/510 |
| 2,296,741 | 9/1942 | Sanders | 62/335 |
| 2,350,886 | 6/1944 | Freimann | 62/510 |
| 3,059,448 | 10/1962 | McGrath | 62/510 |
| 4,176,525 | 12/1979 | Tucker et al. | 62/335 |
| 4,462,460 | 7/1984 | Braver | 62/259.1 |
| 4,683,942 | 8/1987 | Bierkamp et al. | 62/259.1 |
| 4,720,983 | 1/1988 | Mintz | 62/259.1 |

*Primary Examiner*—Albert J. Makay
*Assistant Examiner*—William C. Doerrler
*Attorney, Agent, or Firm*—Bill B. Berryhill

[57] ABSTRACT

Unitized air conditioning apparatus for conditioning air for an enclosed space may include: an inlet chamber through which air may be drawn; first and second selectively operable air handling units by which air may be drawn through the inlet chamber and refrigeration apparatus for circulating refrigerant through the air handling units for heat exchange with air prior to discharge into the enclosed space. Air dampers are provided for isolating one of the air handling units, when not operating, from the other air handling unit when it is operating.

8 Claims, 2 Drawing Sheets

PARTIALLY REDUNDANT AIR CONDITIONING SYSTEM

BACKGROUND OF THE INVENTION

1. Field of the Invention

The present invention pertains to air handling and conditioning apparatus. More specifically, the present invention pertains to apparatus for handling, filtering and temperature conditioning of air for an enclosed space such as a building occupied by humans, computers or other heat sensitive equipment.

2. Brief Description of the Prior Art

For many years, enclosed spaces for human pursuits and habitation have been supplied with conditioned air, i.e. filtered, cooled, heated, humidity controlled air. Such conditioning of the air is especially appropriate for human comfort in warm and humid environments. This is particularly true in work place environments. If the air is not properly conditioned in a work environment, efficiency of the worker may decline and in many cases the workers physical condition may be impaired by poor quality air.

In more recent times, enclosed spaces may be provided for computers, electrical equipment and other technical equipment, instruments and processes. Such equipment may be highly sensitive to temperature and humidity changes.

An air conditioning system for an enclosed space usually provides a filter through which ambient air is drawn, an air handling unit for moving air through the system and a refrigeration unit providing a refrigerant for heat exchange with the air to cool the air prior to entry into the closed space to be conditioned. Occasionally, and frequently in some environments, it may be necessary to service and/or repair one or more of the components of an air conditioning system. This usually necessitates shutting down the entire system for the period of time necessary for the servicing or repair of the component. Such a period of time may be anywhere from a few minutes to several days. In many situations, particularly in industrial work environments, the individual workers cannot function for these periods of time without proper air conditioning. In other situations, temperatures may substantially increase so as to impair function of computers, instruments and other equipment.

Where it is important that the proper conditioning of air not be interrupted, stand by or dual air conditioning systems have been provided in which two complete air conditioning units are provided so that if one unit must be shut down for servicing and/or repair, the other can be utilized for continuous conditioning of the air. While such an arrangement solves the problem of providing continuous air conditioning, it introduces a number of associated problems. Obviously, the cost of providing a dual system is essentially doubled, the space required for a dual system is generally doubled and the maintenance and repair problems are increased. In fact, the standby units which do not operate as frequently as primary units may incur problems simply by non-operation.

Thus it could be seen that the provision of continuously conditioned air to an enclosed space is not without some problems. Alternate solutions are sought and desired, particularly in certain environments.

SUMMARY OF THE PRESENT INVENTION

In the present invention, a unitized air conditioning system is provided in which some, but not all of the components are provided in duplicate so that continuous conditioning of air supplied to an enclosed space is accomplished even if one or more of the components require servicing and/or repair. Thus an object of the present invention is provision of continuously conditioned air while allowing certain ones of the components to be taken out of service for servicing and/or repair.

While some of the components of the air conditioning system of the present invention are duplicated, other non-critical components are not duplicated. Thus the cost, space and maintenance of the air conditioning system of the present invention is less than a totally duplicated system. Thus another object of the present invention is to provide continuous air conditioning, even when one or more components are taken out of service, but with less cost, space and maintenance than a totally duplicated system.

The objects of the present invention are accomplished by providing a common inlet air chamber; first and second selectively operable air handling units by which air may be drawn through the air chamber; at least one refrigeration system for circulating refrigerant to the air handling units for heat exchange with and cooling of air prior to its discharge into an enclosed space. Most importantly, means is provided for isolating one of the air handling units from the inlet air chamber and the other air handling unit when the other air handling unit is operating. This allows one of the air handling units to be selectively operated while the other is out of service for maintenance or repair.

The means for isolating one air handling unit from the other is unique. First and second air dampers are provided through which air must pass into the first and second air handling units respectively. Each of the air dampers are selectively moveable between open positions, in which air may be drawn through its respective air handling unit, and closed positions, in which air flow is blocked from its respective air handling unit. Backdraft dampers are also provided for each air handling unit on the discharge side thereof. The backdraft dampers of the non-operating unit close in response to operation of the other unit to prevent reverse circulation of air flow through the nonoperating unit.

Thus the air conditioning system of the present invention handles and conditions air for an enclosed space so that continuous air conditioning is supplied even if it is required to service or repair one component of the system. This is accomplished by providing some redundancy of components in combination with components that function continuously without redundancy. The objects of the present invention are accomplished with unique combinations of components and uniquely designed parts thereof. A further understanding of the objects and advantages of the invention will be gained from reading the specification which follows in conjunction with the accompanying drawings.

DESCRIPTION OF A PREFERRED EMBODIMENT OF THE INVENTION

Figure 1:
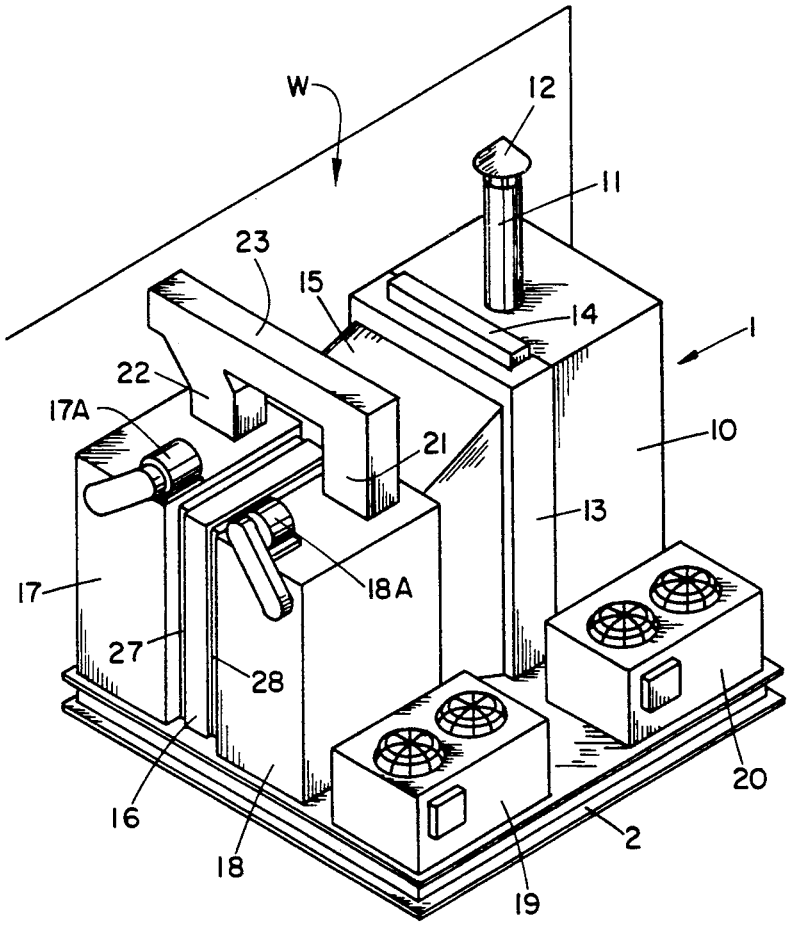
FIG. 1 is a perspective view of a unitized air conditioning system, according to a preferred embodiment of the invention, shown in place for conditioning an adjoining air space.

Referring first to FIG. 1, there is shown a unitized air conditioning system 1, according to a preferred embodiment of the invention for filtering, handling and cooling air for an enclosed space, a wall of which is represented at W. Various componments of the air conditioning system 1 are mounted on a skid or support 2 so that the entire system 1 may be transported in an assembled state from the point of manufacture to the point of use.

The components of the air conditioning system 1 include an air inlet plenum or chamber 10 into which ambient air may be drawn through an air intake stack 11 at the top of which is a conical cover 12. Immediately downstream of chamber 10 is a filter section 13 which may be provided with various types of filters for filtering the incoming air prior to further handling thereof. The filter section may include bulk filled filter material which may be loaded through a hatch 14 and it may also house prefabricated prefilters and postfilters to efficiently filter out unwanted airborn materials.

In the exemplary embodiment, a transition flow passage 15 is provided so that as air leaves the filter section 13 it is funneled into an air chamber 16 which lies between and is common to first and second air handling units 17, 18, respectively. Mounted on the skid 2 adjacent to the air chamber 10 and second air handling unit 18 are first and second refrigeration units 19 and 20.

Each of the air handling units 17, 18, includes a fan (not shown), driven by a motor 17A, 18A, which, when operating, may draw air from the common air chamber 16 and force the air across a heat exchanger (not shown) enclosed in each of the units 17, 18 for heat exchange with a refrigerant therein. The refrigerant in supplied through conduits (not shown) from a refrigerating unit such as 19 and 20, refrigerating unit 19 being for the air handling unit 17 and the refrigerating unit 20 being for the air handling unit 18. It is probably best that refrigerating units 19 and 20 be provided in duplicate. However, some embodiments may utilize a single refrigerating unit for both air handling units 17 and 18. The air forced across the respective heat exchangers is cooled and then discharged through air ducts 21, 22, 23, into the enclosed space, one wall W of which is illustrated in FIGS. 1 and 2.

A very important feature of the present invention is the arrangement of air dampers for cooperation with the first and second air handling units 17, 18. Between the common air chamber 16 and each of the air handling units 17, 18, is an air damper 27, 28. Air passing from the air chamber 16 must pass through one of the dampers 27, 28 into its respective air handling unit 17, 18, prior to discharge into the enclosed space. Each of the dampers is selectively moveable between open positions, in which air is drawn through its respective air handling unit, and closed positions, in which air flow is blocked from its respective air handling unit. These air dampers 27 and 28 may be designed in any suitable fashion. It is contemplated that a louver or slat type damper would be best in this application. The louvers or slats could be manually operated, motor operated or a combination thereof, so that when one air handling unit is operating, e.g. the first air handling unit 17, its damper 27 would be open and the other damper 28 would be closed, isolating the non-operating air handling unit 18 from the air chamber 16 and from the other air handling unit 17. In the alternative, both dampers 27, 28 may be left open until one of the air handling units needs servicing, at which time its damper would be closed.

Figure 2:
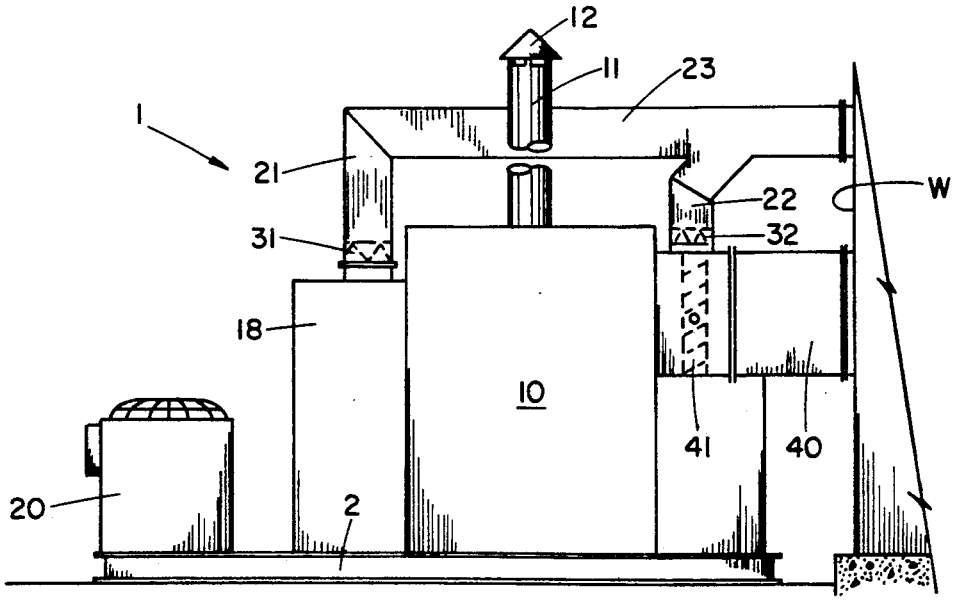
FIG. 2 is an end elevational view of the unitized air conditioning system of FIG. 1.
Figure 3:
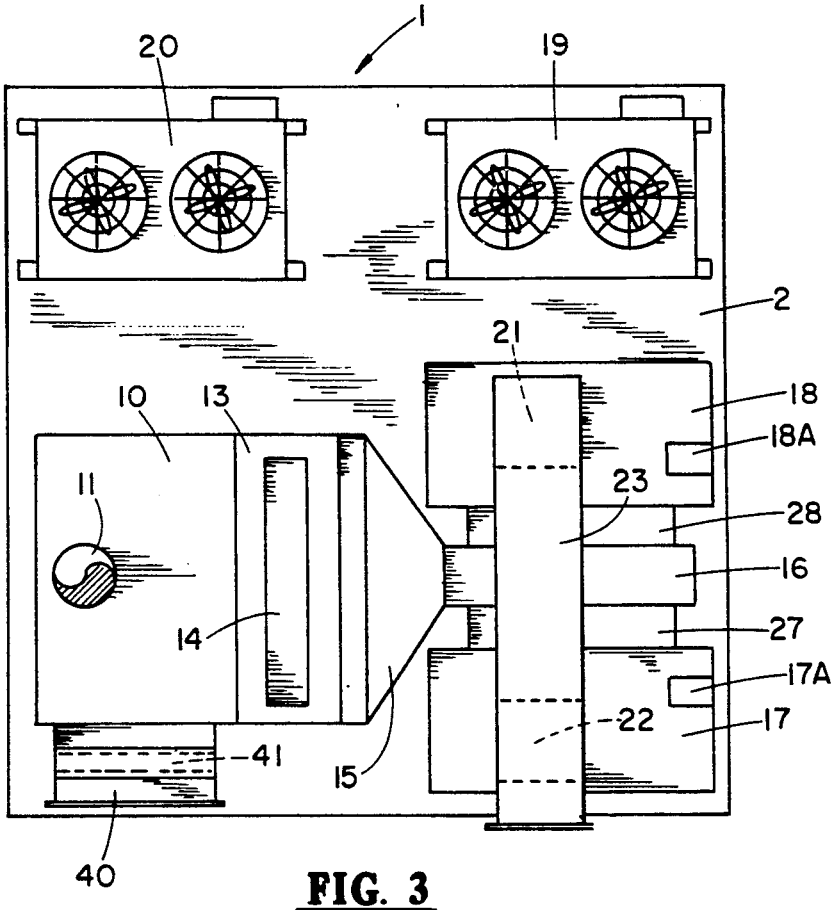
FIG. 3 is a plan view of the unitized air conditioning system of FIGS. 1 and 2, portions of the components thereof being broken away for a better understanding thereof.
Figure 4:
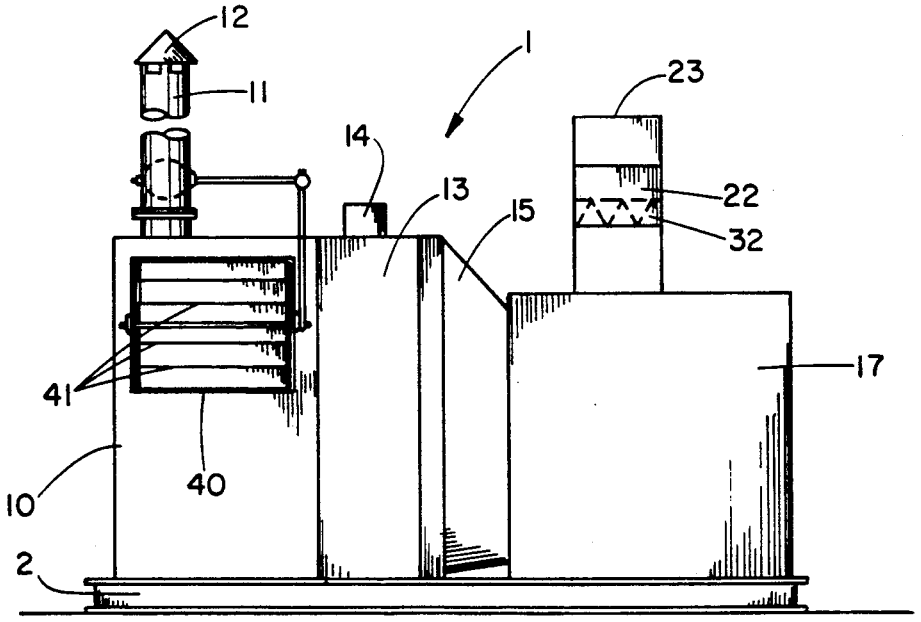
FIG. 4 is a side elevation view, portions of which are in section, of the unitized air conditioning system of FIGS. 1, 2 and 3.

In addition, each of the discharge ducts 21, 22 is provided with a backdraft damper such as the backdraft damper 31 in FIG. 2 and 32 in FIG. 4. The backdraft dampers 31, 32 are designed so that they permit air to be discharged from their respective air handling units into the air duct 23 for eventual flow into the air space enclosed by the wall W but do not allow reverse flow therethrough. In other words, each of the backdraft dampers opens in response to operation of its respective air handling unit and closes in response to non-operation of its respective air handling unit so as to prevent reverse circulation of air through a non-operating air handling unit.

It will be noted that a return air duct 40 provides air flow communication between the space enclosed by wall W and the inlet air chamber 10. Thus, some of the air in the enclosed space may return through the return air duct 40 for recirculation through the system. An air damper 41 is provided in the return air duct 40 and is provided with pressure controls so that a positive pressure is maintained in the enclosed space at all times, even when a door to the space is opened. In such case the damper 41 would close to maintain positive pressure in the enclosed space. There is also a pressure damper 42 in the inlet air stack 11 which would open and close in response to certain events. For example, if there were a loss of building pressure, the damper 42 would be full open. A sensor (not shown) could be placed in the stack 11 to sense hydrogen sulfide or other harmful substances so that if these substances exceed predetermined amounts, the damper 42 would be closed to prevent entry into the enclosed space.

Now to understand operation of the unitized air handling and conditioning system 1, it will be assumed that the first air handling unit 17 and the first refrigeration unit 19 are operating and the second air handling unit 18 and second refrigeration unit 20 are not. Air is drawn through the inlet stack 11 into the inlet air chamber 10. The air passes through the filter unit 13 into the common air chamber 16. Since the air handling unit 18 is not operating, its isolation damper 28 may be closed preventing air flow therethrough. The isolation damper 27 is open, allowing air to flow through the operating air handling unit 17 where the air is cooled by heat exchange with refrigerant from the refrigerating unit 19. The filtered and cooled air then passes through the open backdraft damper 32 and air duct riser 22 into the air duct 23 for discharge into the space enclosed by the wall W. Some of the air may return through the return duct 40 and return damper 41 into the air chamber 10 for recirculation through the system.

While the first air handling unit 17 is operating, the isolation damper 28 of the second air handling unit 18 may be closed. In addition, the backdraft damper 31 associated with the second air handling unit 18 is closed, preventing reverse air circulation through the non-operating air handling unit 18. Since the non-operating air handling unit 18 may be totally isolated from the air flow through the system, it can be repaired or serviced without having any effect on the supply of air to the space enclosed by the wall W. Likewise, the non-operating refrigeration unit 20 can be serviced. The same is true of the air handling unit 17 and the refrigeration unit 19 when they are not operating.

A single embodiment of the invention has been described herein. Many variations of the invention can be made without departing from the spirit of the invention. For example, the common air chamber, both air handling units, both isolation dampers and both backdraft dampers may be housed in a single housing, compartmentalized for selected intake and discharge of air. In any event, it is intended that the scope of the invention be limited only by the claims which follow.

I claim:

1. Unitized air conditioning apparatus for conditioning air for an enclosed space, said apparatus comprising:

an inlet air chamber through which air may be drawn;

first and second selectively operable air handling units by which air may be drawn through said inlet air chamber for subsequent discharge into said enclosed space;

refrigeration means for circulating refrigerant through said air handling units for heat exchange with said air prior to its discharge into said enclosed space; and a common air chamber between said air handling units through which air passes from said inlet air chamber to either one of said air handling units, said common air chamber being provided with first and second isolation dampers through which said air must pass into said first and second air handling units, respectively, prior to said discharge into said enclosed space, each of said isolation dampers being selectively moveable between open positions, in which air is drawn through its respective air handling unit, and closed positions, in which air flow is blocked from its respective air handling unit.

2. Unitized air conditioning apparatus as set forth in claim 1 including first and second air handling units, respectively, flows for discharge into said enclosed space, each of said backdraft dampers opening in response to operation of its respective air handling unit and closing in response to non-operation of its respective air handling unit to prevent reverse circulation of air flow through a non-operating air handling unit.

3. Unitized air conditioning apparatus as set forth in claim 1 including a return air duct through which at least portion of the air discharged into said enclosed space may be recirculated through said inlet air chamber and one of said air handling units.

4. Unitized air conditioning apparatus as set forth in claim 1 in which said inlet air chamber is supplied with ambient air through an inlet air duct, said inlet air duct being provided with closure means responsive to an ambient air sensor to block ambient air into said inlet air chamber if the condition of said ambient air does not comply with predetermined standards.

5. Unitized air conditioning apparatus for filtering and temperature conditioning of air for an enclosed space, said apparatus comprising:

a filter unit through which air may be drawn;

first and second selectively operable air handling units by which air may be drawn through said filter unit and subsequently discharged into said enclosed space;

first and second selectively operable refrigerating units for cooling of refrigerants for circulation through said first and second air handling units, respectively, in heat exchange with said air prior to its discharge into said enclosed space; and a common air chamber between said air handling units through which air passes from said filter unit to either one of said air handling units, opposite sides of said common air chamber being provided with first and second isolation air dampers through which said air must pass into said first and second air handling units, respectively, prior to said discharge into said enclosed space, each of said isolation dampers being selectively moveable between fully opened positions and fully closed positions, each of said isolation dampers, when in said fully closed positions, isolating its respective air handling unit form said filter unit and the other air handling unit.

6. Unitized air conditioning apparatus as set forth in claim 5 in which each of said first and second isolation dampers is provided with operator means by which said first and second isolation dampers may be moved between said fully opened position, said fully closed position and selected positions therebetween.

7. Unitized air conditioning apparatus as set forth in claim 5 including an air passage into which air is discharged from a selected one of said air handling units and from which said air is discharged into said enclosed space.

8. Unitized air conditioning apparatus as set forth in claim 7 including first and second backdraft dampers through which air from said first and second air handling units, respectively, is discharged into said air passage, each of said backdraft dampers opening in response to operation of its respective air handling unit and closing in response to operation of the other air handling unit to prevent reverse circulation of air flow through a non-operating air handling unit.

* * * * *